United States Patent [19]

Hanyu et al.

[11] Patent Number: 4,784,073

[45] Date of Patent: Nov. 15, 1988

[54] DEVICE OF A SEWING MACHINE FOR FORMING BLIND STITCHES

[75] Inventors: Susumu Hanyu; Akio Koide, both of Tokyo, Japan

[73] Assignee: Janome Sewing Machine Co., Ltd., Tokyo, Japan

[21] Appl. No.: 894,980

[22] Filed: Aug. 8, 1986

[30] Foreign Application Priority Data

Aug. 9, 1985 [JP] Japan ..... 60-174033

[51] Int. Cl.[4] ..... D05B 3/02; D05B 1/24

[52] U.S. Cl. ..... 112/453; 112/176; 112/140; 112/151

[58] Field of Search ..... 112/453, 450, 445, 454, 112/458, 151, 140, 176, 177, 178

[56] References Cited

U.S. PATENT DOCUMENTS 3,795,209 3/1974 Smith ..... 112/151 X
4,223,616 9/1980 Kunimatsu et al. ..... 112/458
4,335,667 6/1982 Beckerman et al. ..... 112/445
4,389,954 6/1983 Makabe et al. ..... 112/454

*Primary Examiner*—Peter Nerbun
*Attorney, Agent, or Firm*—Michael J. Striker

[57] ABSTRACT

In a sewing machine which stores stitch control signals in an electronic memory composed with a microcomputer, incorporated therein are a stitch selecting device, a blindstitching depth setting device and a blindstitching width setting device which are both independently set by operation of said stitch selecting device. When a blindstitching pattern is selected, said depth setting device and width setting device are made operative, and needle dropping left positions are set by said depth setting device, and right dropping positions or whole amplitudes are set by said width setting device, and they are input to the memory for forming the blindstitching patterns by the stitching control signal of the blindstitching pattern.

9 Claims, 5 Drawing Sheets

DEVICE OF A SEWING MACHINE FOR FORMING BLIND STITCHES

BACKGROUND OF THE INVENTION

Field of the invention

The present invention relates to an electronically controlled device of a sewing machine for forming blind stitches, which may vary in dependence upon the thickness of a fabric to be sewn.

It is generally known that a blind stitch pattern has a width (W) between a left needle dropping position (L) and a right needle dropping position (R) as shown in FIG. 7. Further, it is generally known that the left needle dropping position (L) is a reference along which is guided an end part of the upper fold of a fabric to be sewn as shown in FIG. 8.

In FIG. 9, a basic line of a needle position is designated by an "X", which corresponds to one of the L, M, and R needle positions as is generally known. If the basic line X is set to the left needle dropping position L as shown in FIG. 9(*a*), the left needle dropping position (L) is fixed, and the right needle dropping position (R) is variable as shown by $R_1$, $R_2$, $R_3$ relative to the left needle dropping position (L).

If the basic line is set to the right needle dropping position R as shown in FIG. 9(b), the right needle dropping position (R) is fixed, and the left needle dropping position (L) is variable as shown by $L_1$, $L_2$, $L_3$ relative to the right needle dropping position R.

If the basic line is set to the middle needle dropping position (M) as shown in FIG. 9(*c*), the left and right needle dropping positions L, R are varied at the same ratio with respect to the needle position M.

The fabric F is folded as shown in FIGS. 10(*a*) to (*c*) to provide therein an upper fold F, and a lower fold $F_2$ to be blind-stitched. The edge of the upper fold $F_1$ is set laterally to a guide G of a blind stitching presser foot 17 as shown in FIGS. 8, 13, 16 and 17, in which the presser foot 17 is pressed against the upper and lower folds $F_1$, $F_2$ of the fabric F and the guide G is pressed against the lower fold $F_2$. The guide G may be fixed to the presser foot 7 as shown in FIG. 13 or may be adjustable laterally of the presser foot 17 as shown in FIGS. 16 and 17.

It is then required to set the left needle dropping position L to an appropriate position on the fabric F where a machine needle 6 penetrates the upper and lower folds $F_1$, $F_2$ of the fabric F as shown in FIG. 8. More precisely the appropriate position is represented by (a) in FIG. 11, the position being slightly spaced away inward from the edge of the upper fold F, so that the formed stitches S may not be conspicuous as shown in FIG. 12(*a*) when the uppermost part of the fabric F is unfolded. The stitches S in FIG. 12(*a*) are shown in contrast to the conspicious stitches $S_1$ which are undesirous and may be formed when the left needle dropping position L is set to the position (b) on the fabric F in FIG. 11 where the needle is spaced far away inward from the edge of the upper fold $F_1$, compared with the needle position (a). Moveover such conspicuous stitches $S_1$ will cause shrinkage of the fabric when the latter is unfolded. On the other hand, if the left needle dropping position L is set to a position (c) in FIG. 11 where the needle is spaced away outward from the edge of the uper fold $F_1$, the blind stitches are not formed on the upper fold $F_1$ and result in failure of the blind stitching function as shown in FIG. 12(*c*).

With respect to forming of the blind stitches, there have been generally three types as follows:

(1) A blind stitching presser foot having a guide fixed thereto is employed in combination with a sewing machine storing a blind stitch pattern of a predetermined amplitude;

(2) A blind stitching presser foot having a guide fixed thereto is employed in combination with a sewing machine storing a blind stitch pattern, the amplitude and basic line of which may be varied; and (3) A blind stitching presser foot having a guide provided as being adjustable laterally thereof is employed in combination with a sewing machine storing a blind stitch pattern, at least the amplitude of which may be varied.

In case of item (1), the blind stitching presser foot 17 having the guide G fixed thereto as shown in FIG. 13 is employed in combination with the sewing machine as mentioned in the item. In this case, the needle positions are constant on both sides of the guide G. However because of the possible divergences in precision of parts in each of the sewing machines, it is generally designed that the guide G be mounted on the presser foot 17 such that the needle may drop at the left position L where the needle is sufficiently spaced away inward from the edge of the upper fold $F_1$ to secure the correct formation of blind stitches. More precisely, the dimension (d) in FIG. 8 is amplified more than normally required, and this often causes the conspicuous (large) stitches $S_1$ which are undesired.

In case of item (2), the blind stitches may be produced in the manner as shown in FIG. 9(*a*), FIG. 9(*b*) or FIG. 9(*c*), in which the amplitude may be varied with respect to the basic line L, R or M as mentioned thereinbefore. In case of FIG. 9(*a*), the right needle dropping position R may be variably set from the fixed left needle dropping position L. However as the distance (d) in FIG. 8 is predetermined by the guide G with an amplified dimension for the reason as mentioned above, this may cause such conspicuous stitches $S_1$. In case of FIG. 9(*b*), the left needle dropping position L may be variably set from the fixed right needle dropping position R. However as the distance (d) in FIG. 8 is predetermined by the guide G with an amplified dimension, this may cause the lower fold $F_2$ of a considerable size of dimension E to the left loose as shown in FIGS. 14 and 15. In case of FIG. 9(*c*), if one of the left and right needle dropping positions L, R is varied, and therefore the defects as mentioned in item 1 and in case of FIG. 9(*b*) may result.

In case of item (3), the guide G may be adjusted laterally of the presser foot 17 as shown in FIGS. 16 and 17 to variably determine the distance (d) of the blind stitch in FIG. 8. However the mechanical play of the presser foot structure will fail to stabilize the guide G in the set position relative to the presser foot 17 resulting in divergences of the blind stitches formed on the fabric.

For solving the above mentioned problems, the present invention incorporates a stitching pattern selecting device, a blind stitch width setting device and a blind stitch depth setting device which are independently set by operation of said selecting device in a sewing machine which stores stitch control signals in an electronic memory composed by a microcomputer, and connects said setting devices with the electronic memory.

When the blind stitch pattern is selected, the blind stitch width setting device and the blind stitch depth setting device are made operative. The left needle dropping position is set by the blind stitch depth setting device, and the right needle dropping position or the whole amplitude is set by the blind stitch width setting device. The set conditions are stored in the memory in a form of data for forming the blind stitch pattern.

DESCRIPTION OF THE PREFERRED EMBODIMENTS OF THE INVENTION

Figure 2:
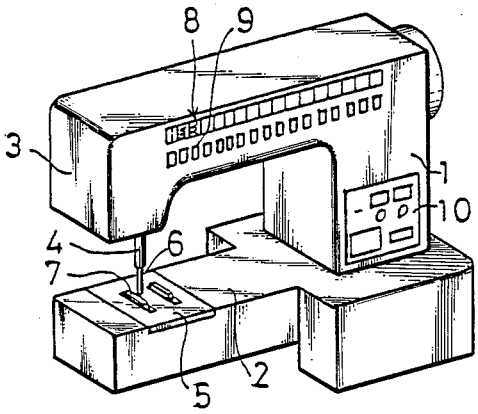
FIG. 2 is a perspective view of a sewing machine incorporating the invention.
Figure 1:
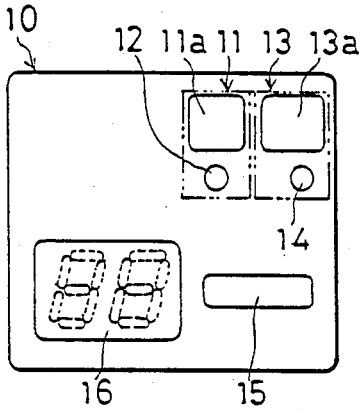
FIG. 1 is an explanatory view of a blind stich setting device of the invention.

In reference to FIGS. 1 and 2, a sewing machine 1 is incorporated with a microcomputer including a control part and an electronic memory storing data for a number of different stitch patterns including a blind stitch pattern. The sewing machine 1 is provided with an arm 3 overhanging a bed 2 thereof. The arm 3 supports a needle bar 4 having a needle 6, which is moved vertically by a drive mechanism with respect to a needle plate 5 positioned in the bed 2. A feed dog 7 appears at oblong grooves formed in the needle plate 5, and feeds the fabric in the normal forward and backward directions in association with a presser metal (not shown).

Figure 7:
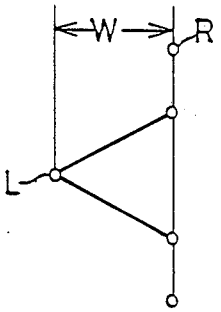
FIG. 7 is a diagrammatic view of a standard blind stitch pattern.
Figure 9A:
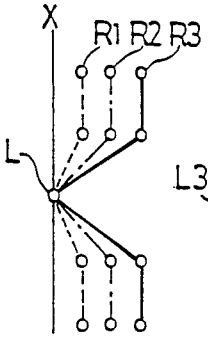
FIGS. 9(*a*)–9(*c*) are diagrammatic views of the conventionally adjustable needle dropping positions of the blind stitch pattern.
Figure 9B:
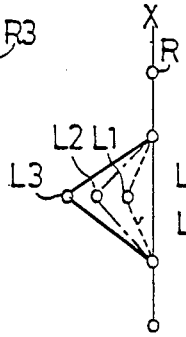
Figure 9C:
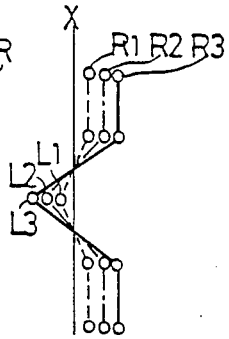

FIG. 2 shows a number of different pattern indicia 8, the data of which are stored in a temporary storing memory. A number of pattern selecting switches 9 are shown which are selectively operated to select the patterns 8 including a blind stitch pattern as shown in FIG. 7. A pattern adjusting device 10 is shown with a blind stitch depth setting device 11, an operating switch 11*a*, an LED 12 activated in association with the switch 11*a*, a blind stitch width setting device 13, an operating switch 13*a*, an LED 14 activated in association with the switch 13a, adjusting switch 15 which is operated to change set values of the blind stitch width and depth, and an indicator 16 for indicating therein a set value for adjusting the blind stitch.

Figure 3:
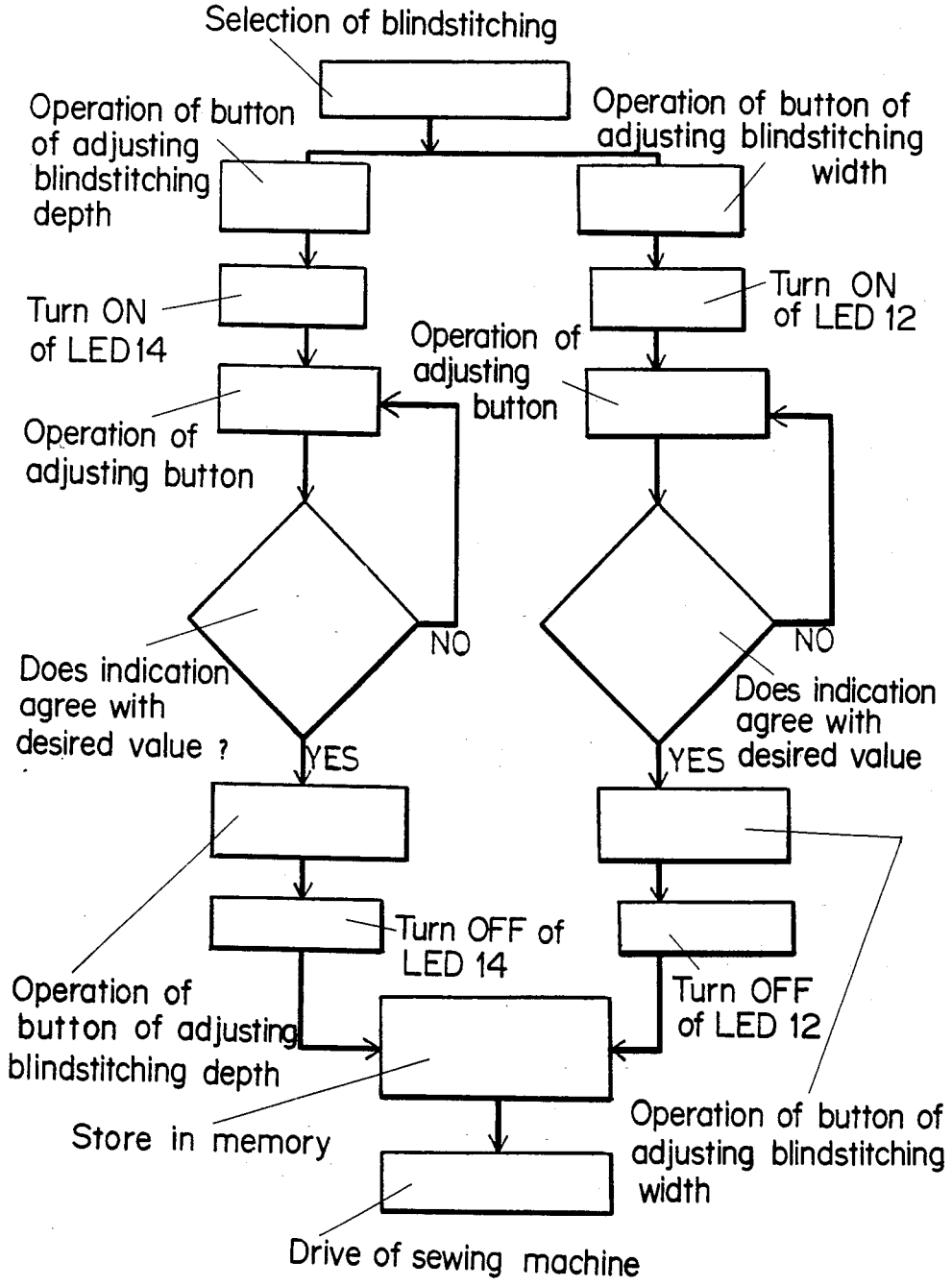
FIG. 3 is a block diagram flow chart for producing the blind stitches.

Operation by the blind stitch pattern adjusting device 10 will be explained with reference to the block diagram of FIG. 3.

Figure 8:
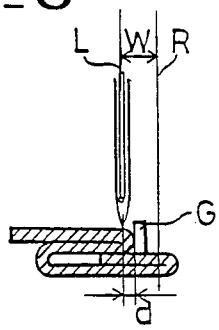
FIG. 8 is a view showing a way for forming the stitches of the blind stitch pattern.
Figure 10A:
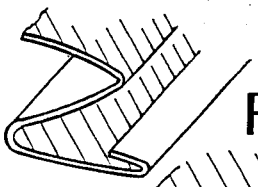
FIGS. 10(*a*)–10(*c*) are explanatory views of a fabric folded for the blind stitches.
Figure 10B:
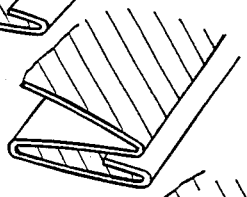
Figure 10C:
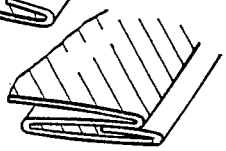
Figure 11:
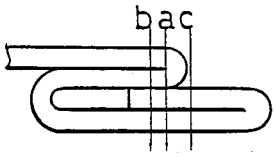
FIG. 11 is an explanatory view typically showing the needle dropping positions on one side of the blind stitch width.
Figure 12A:
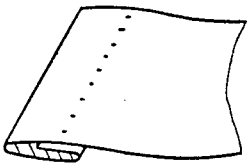
FIGS. 12(*a*)–12(*c*) are explanatory views of the exposed stitches in the upper surface of the fabrics when the latter are unfolded.
Figure 12B:
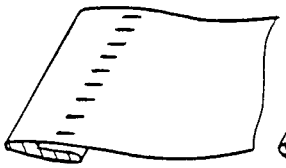
Figure 12C:
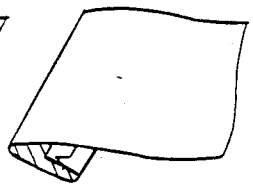
Figure 13:
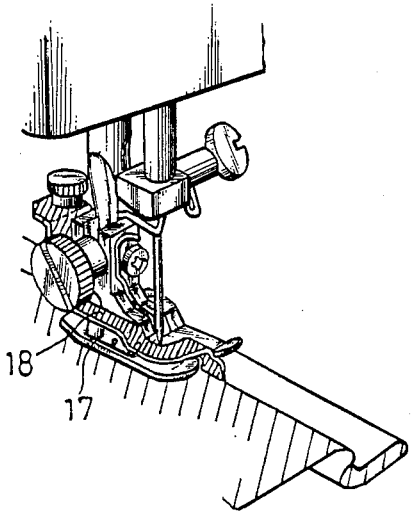
FIG. 13 is a perspective view showing a presser foot having a guide fixed thereto and attached to a sewing machine.
Figure 14:
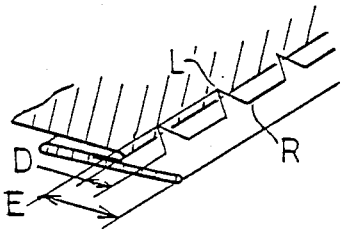
FIGS. 14 and 15 are explanatory views showing the blind stitches which may be formed by using the presser foot shown in FIG. 13.
Figure 15:
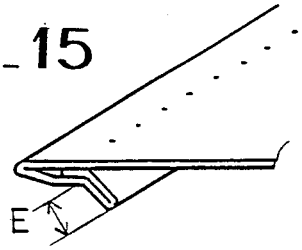
Figure 16:
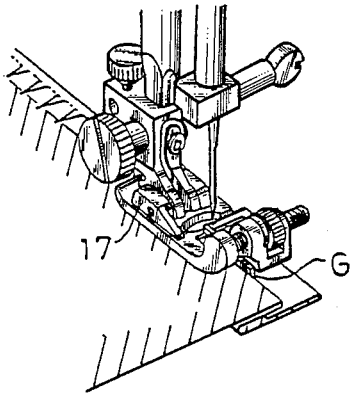
FIG. 16 is a perspective view of a presser foot having a guide which is adjustable laterally thereof and attached to a sewing machine.
Figure 17:
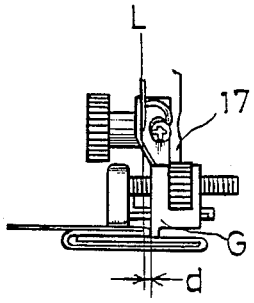
FIG. 17 is a front view of the above.

A blind stitching fabric presser 17 has a fabric guide 18 attached thereto as seen in FIG. 13, and a fabric $F_1$ is folded in the order as shown in FIGS. 10(*a*), 10(*b*) and 10(*c*) to provide an upper fold $F_1$ and a lower fold $F_2$. Then lower fold $F_2$ is placed under the fabric guide G and the upper fold $F_1$ is brought in contact with one side of the guide G, so that the upper fold $F_1$ may be guided along the guide G as the fabric $F_1$ is transported as shown in FIGS. 8 and 13.

If one of the pattern selecting switches 9 is operated to select a standard blind stitch pattern, the blind stitch adjusting device 10 is made operative to enable the operator to adjust the blind stitch in dependence upon the thickness of fabric $F_1$, and if the operation switch 13*a* of the blind stitch depth setting device 13 is operated, LED 14 is lighted to indicate that the blind sitch depth may be set.

After switch 13*a* is operated, the adjusting switch 15 is operated to change a set value, which is shown in the indicator 16 as a digital number. This set value is a comparative value with respect to a predetermined left needle dropping position ($L_o$) of a selected standard blind stitch of width W of FIG. 4 and indicates a "+", which is indicative of a direction relative to the predetermined left needle dropping position $L_o$ where the blind sitch depth is greater, and indicates a "−", which is indicative of a direction where the blind stitch depth is less.

When the indication of the indicator 16 comes to a desired value, the blind stitch depth switch 13*a* is finally operated to turn off LED 14 and the setting is completed. The set value is stored in the memory as the left needle dropping position of the blind stitch. Thus, the blind stitch depth has been determined as desired. If the switch 11*a* is operated, LED 12 is lit to indicate that the blind stitch width may be set.

After switch 11*a* is operated, the adjusting switch 15 is operated to change a set value, which is shown in the indicator 16 as a digital number. This set value is a comparative value with respect to a predetermined right needle dropping position ($R_o$) of the selected standard blind stitch of width W of FIG. 4 and indicates a "+", which is indicative of a direction relative to the right needle dropping position $R_o$ where the blind stitch width is greater, and indicates a "−", which is indicative of a direction where the blind stitch width is less.

When the indication comes to a desired value, the blind switch width switch 11*a* is finally operated to turn off LED 12 and the setting is completed. The set value is stored in the memory as the right needle dropping position of the blind stitch. Thus, the blind stitch width W is determined as desired.

Under these conditions, the sewing machine is driven to form the blind stitches.

A second embodiment will be explained with reference to FIGS. 1 to 3 and 5. The explanation about the structure of the sewing machine is omitted, since it is the same as above said. In this embodiment, different is actuation of the blind stitch device of FIG. 1.

Figure 4:
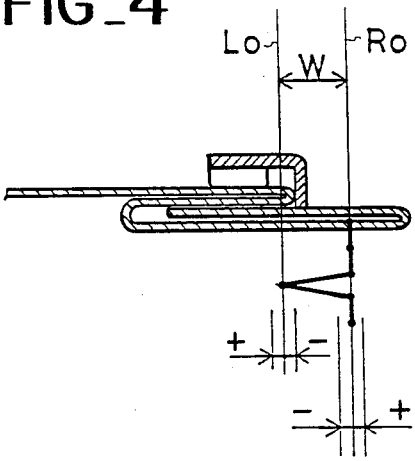
FIG. 4 is an explanatory view of adjustable needle dropping positions of blind stitches according to the invention.
Figure 5:
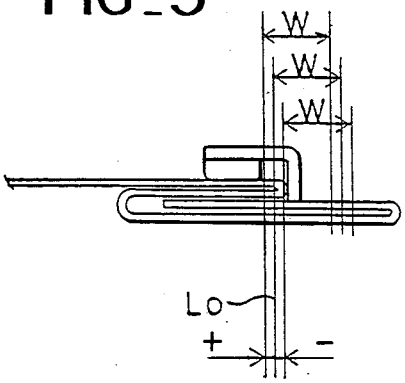
FIG. 5 is an explanatory view of adjustable needle dropping positions of blind stitches according to a second embodiment of the invention.

The fabric $F_1$ is folded, and set to the fabric guide G of presser foot 17 as shown in FIG. 5 just in the same way as shown in FIG. 4. If the blind stitch pattern selecting button 9 is operated to select the blind stitch pattern, the blind stitch adjusting device 10 is made operative. The blind stitch width setting device 11 is operated, LED 14 is lit to indicate that the blind stitch width W may be varied. The adjusting switch 15*a* or 15*b* is operated for adjusting the blind stitch width W. The set value is indicated in the digital indicator 16 as the blind stitch width.

When the indication comes to a desired value, the blind stitch width switch 11*a* is finally operated to turn off LED 12 and the setting is completed. The set value is stored in the memory as amplitude of the blind stitch pattern. If the switch 13*a* is then operated, LED 14 is lighted to indicate that the blind stitch depth may be freely set, and the adjusting switch 15*a* or 15*b* is operated to change the set value.

After switch 13*a* is operated, the adjusting switch 15 is operated to change a set value. This set value is shown in the indicator 16 as a digital number. This set value is a comparative value with respect to a left needle dropping position ($L_o$) of the selected standard blind stitch of width W of FIG. 5. An indicium of "+" indicates a direction relative to the left needle dropping position $L_o$ where the blind stitch depth is greater and an indicium of "−" indicates a direction where the blind stitch depth is less.

When the left needle dropping position is optionally determined for this embodiment with respect to the predetermined left needle dropping position $L_o$, the blind stitch pattern of the set width W is shifted as a whole laterally of the predetermined left needle dropping position $L_o$.

When the indication comes to a desired value, the blind stitch depth switch 13*a* is operated and the LED 14 is turned off, the setting is completed. The set value is stored in the memory as the left needle dropping position of the blind stitch. Thus, the desired size and position of the blind stitch is determined. Under these conditions, the sewing machine is driven to form the set blind stitches.

Figure 6:
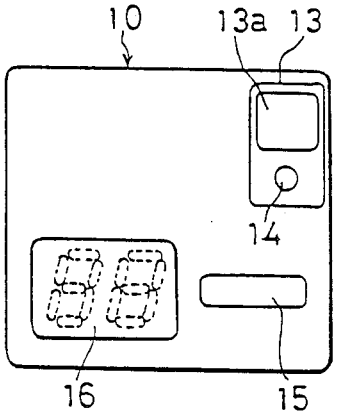
FIG. 6 is an explanatory view of a blind stitch setting device according to a third embodiment of the invention.
Figure 18:
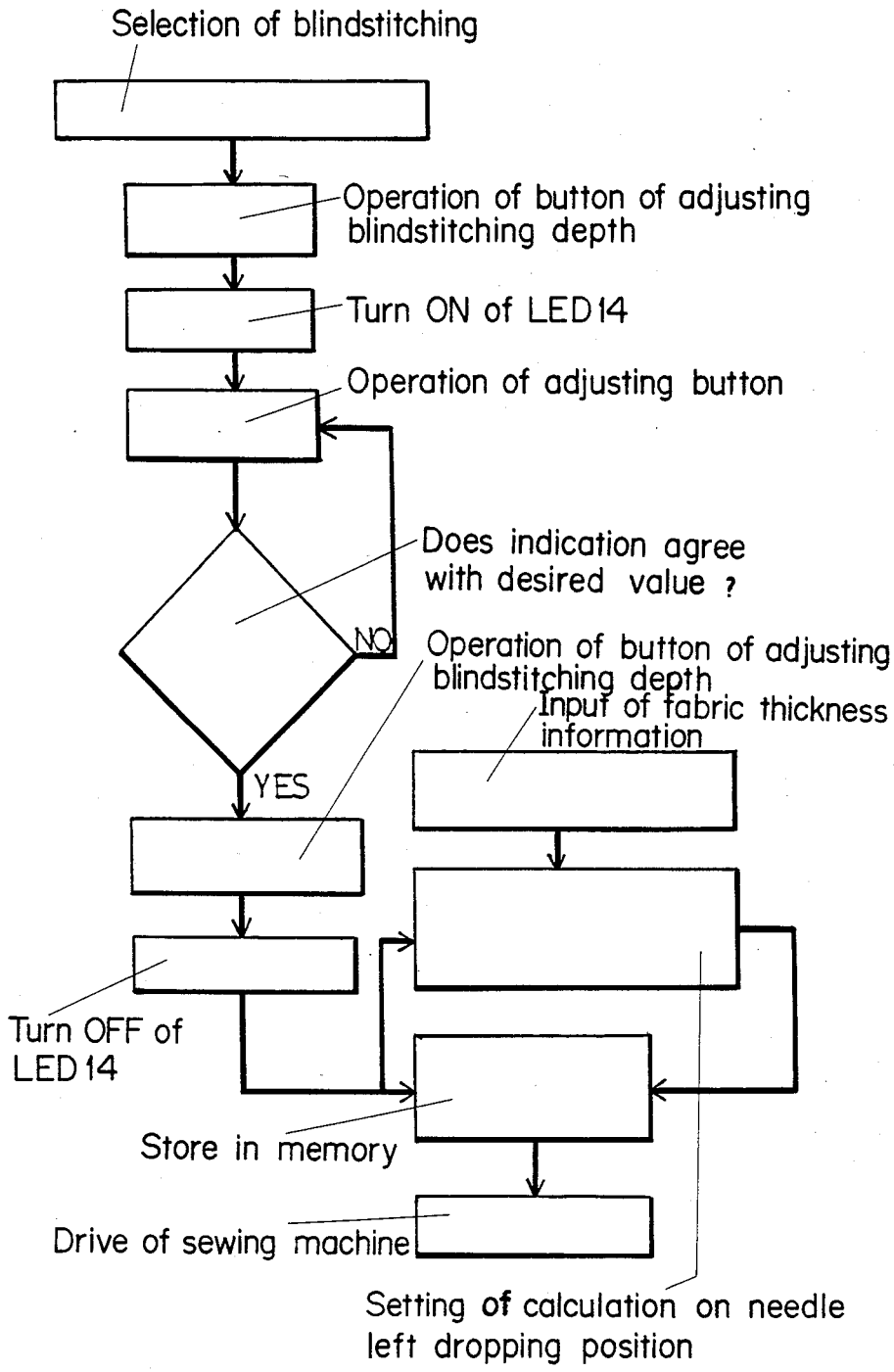
FIG. 18 is a block diagram flow chart for producing blind stitches in accordance with a third embodiment of the invention.

A third embodiment of the invention will be explained with reference to FIGS. 6 and 18. Only a setting manner of the blind stitch width is different from that of the second embodiment, and the others are the same, and omission will be made to details.

The fabric is folded and set to the fabric guide G in FIGS. 4 or 5, and a proper blind stitch depth, that is, the left needle dropping position is set by operating the blind stitch depth setting device 13 and the adjusting switch 15.

According to this embodiment, the right needle dropping position is automatically set by means of a detecting device which is operatively connected to the fabric presser bar and detects a vertical position of the presser foot to thereby detect the thickness of the fabric to be sewn and produce an electric signal as particularly disclosed in U.S. Pat. No. 4,301,757 of the same applicant, because the amplitude of blind stitch should be generally determined in dependence upon the fabric thickness. Then a calculating port of the microcomputer makes a calculation with the electric signal representing the thickness of the fabric and the value of the indicator 16 representing the right needle dropping position and produces an electric signal to cause the control port of the microcomputer to set the left needle dropping position.

What is claimed is:

1. A device of a sewing machine for forming blindstitches having a microcomputer including control means, a needle vertically reciprocating and swinging between two needle positions laterally of a fabric feeding direction, memory means storing switch control data for a plurality of different stitch patterns including a pattern of blindstitches, a fabric presser foot having a fabric guide provided thereon for guiding a fabric in the fabric feeding direction, the fabric being folded in a predetermined mode and set to the fabric guide so that the blindstitches may be formed on the fabric, and pattern selecting means including a plurality of switches selectively operated to select the stitch patterns including the pattern of blindstitches, said device comprising blindstitch depth setting means (13) and blindstitch width setting means (11) activated after one of said pattern selecting switches is operated to select the pattern of blindstitches; operating means including an operating switch (15), said operating switch (15) being responsive to said blindstitch depth setting means (13) being operated to cause said control means to set one of said two needle positions in a direction relative to said fabric guide (G) on one side thereof, said operating switch being activated after said blindstitch width setting means (11) has been operated to cause said control means to set the other of said needle positions in a direction relative to said fabric guide (G) on the other side thereof; and indicating means (16) operated in response to an operation of said operating switch to digitally indicate a value representing the needle position.

2. The device as defined in claim 1 further comprising lamp means (12 or 14) pertaining to each of said blindstitch depth setting means (13) and said blindstitch width setting means (11), said lamp means being turned on when said blindstitch depth setting means and said blindstitch width setting means are selectively operated.

3. A device of a sewing machine for forming blindstitches having a microcomputer including control means and calculating means, a needle vertically reciprocating and swinging between two needle positions laterally of a fabric feeding direction, memory means storing switch control data for a plurality of different stitch patterns including a pattern of blindstitches, a fabric presser foot having a fabric guide provided thereon for guiding a fabric in the fabric feeding direction, the fabric being folded in a predetermined mode and set to the fabric guide so that the blindstitches may be formed on the fabric, detecting means operatively connected to the fabric presser foot to detect a vertical position of the fabric presser foot which is variable in dependence upon the thickness of the fabric to thereby produce an electric signal indicating the thickness of the fabric to be sewn, and pattern selecting means including a plurality of switches selectively operated to select the stitch patterns including the pattern of blindstitches, said device comprising blindstitch depth setting means (13) and blindstitch width setting means activated after one of said pattern selecting switches is operated to select the pattern of blindstitches; operating means including an operating switch (15), said operating switch (15) being activated after said blindstitch depth setting means (13) has been operated to cause said control means to set one of said two needle positions in a direction relative to said fabric guide (G) on one side thereof, said operating switch being activated after said blindstitch width setting means (11) has been operated; indicating means (16) operated in response to operation of said operating switch to digitally indicate a value representing the needle position, said calculating means making a calculation with said electric signal indicating the thickness of the fabric and said value representing the needle position to thereby provide an electric signal for causing said control means to set the other of said two needle positions on the other side of said fabric guide.

4. The device as defined in claim 3 further comprising lamp means (14) pertaining to said blindstitch depth setting means (13), said lamp means being turned on when said blindstitch depth setting means is operated.

5. A device of a sewing machine for forming blindstitches that has a needle vertically reciprocating and laterally swingling between two needle positions, the device comprising:

control means for setting the needle position into which the needle is to swing;

a fabric presser foot having guiding means for guiding a prefolded fabric to be stitched in a fabric feeding direction, said guiding means including a fabric guide along which the prefolded fabric is to be set, said fabric guide having one side and an other side;

pattern selecting means for selecting stitch patterns prestored in a memory means that has a prestored pattern of blindstitches;

depth setting means (13) responsive to said pattern selecting means for setting blindstitch depth;

width setting means (11) responsive to said pattern selecting means for setting blindstitch width; and operating means responsive to said depth setting means (13) for causing said control means to change said setting of one of the needle positions relative to said one side of said fabric guide and also responsive to said width setting means (11) for causing said control means to change said setting of the other of the needle positions relative to said other side of said fabric guide.

6. The device as defined in claim 5 further comprising:

indicating means (16) responsive to said operating means for indicating a value representing the needle position.

7. The device as defined in claim 6, wherein said indicating means is formed to indicate said value digitally.

8. The device as defined in claim 7, wherein said fabric presser foot has a vertical position that is variable in dependence upon a thickness of the fabric to be stitched; further comprising:

detecting means responsive to said fabric presser foot to detect said vertical position of said fabric presser foot.

9. The device as defined in claim 8, wherein said detecting means is formed to produce a signal indicative of said vertical position of said fabric presser foot as detected.

* * * * *